US009976250B2

(12) United States Patent
Smith

(10) Patent No.: US 9,976,250 B2
(45) Date of Patent: May 22, 2018

(54) GLOVE INVERTER

(71) Applicant: Gregory J. Smith, Oakland, CA (US)

(72) Inventor: Gregory J. Smith, Oakland, CA (US)

(73) Assignee: Gregory J. Smith, Oakland, CA (US)

( * ) Notice: Subject to any disclaimer, the term of this patent is extended or adjusted under 35 U.S.C. 154(b) by 39 days.

(21) Appl. No.: 14/927,087

(22) Filed: Oct. 29, 2015

(65) Prior Publication Data

US 2016/0069014 A1 Mar. 10, 2016

Related U.S. Application Data

(63) Continuation-in-part of application No. 12/218,837, filed on Jul. 17, 2008, now abandoned.

(51) Int. Cl.

| | |
|---|---|
| ***A47G 25/90*** | (2006.01) |
| ***D06G 3/02*** | (2006.01) |
| ***A41D 19/04*** | (2006.01) |
| *D06F 59/04* | (2006.01) |

(52) U.S. Cl.

CPC ..... *D06G 3/02* (2013.01); *A41D 19/043* (2013.01); *A47G 25/904* (2013.01); *D06F 59/04* (2013.01)

(58) Field of Classification Search

CPC ..... A47K 2010/3863; A47K 10/24

See application file for complete search history.

(56) References Cited

U.S. PATENT DOCUMENTS

| | | | | |
|---|---|---|---|---|
| 1,013,539 | A * | 1/1912 | Faerber | A47F 8/02 132/56 |
| 1,699,265 | A | 1/1929 | Ammon | 223/39 |
| 1,744,859 | A | 1/1930 | Baum | 223/40 |
| 1,766,502 | A | 6/1930 | Baum | 223/40 |
| 2,058,065 | A | 10/1936 | Dersom | 223/41 |
| 2,375,093 | A | 5/1945 | Fenwick | 223/1 |
| 2,427,933 | A | 9/1947 | Summers | 223/40 |
| 2,601,504 | A | 6/1952 | Cripe | 223/40 |
| 3,516,583 | A | 6/1970 | Petty | 223/39 |
| 3,637,119 | A | 1/1972 | Blair | 223/39 |
| 3,738,547 | A | 6/1973 | Horton | 223/40 |
| 4,436,231 | A | 3/1984 | Kelly et al. | 223/40 |
| 4,620,649 | A | 11/1986 | Graham | 223/40 |
| 5,499,590 | A | 3/1996 | Kamewada | 223/106 |
| 6,279,792 | B1 | 8/2001 | Neal | 223/111 |
| 6,302,348 | B1 | 10/2001 | Leilelund | 242/422.5 |
| 6,568,572 | B1 | 5/2003 | Smith | 223/42 |
| 7,210,603 | B2 * | 5/2007 | Smith | A41D 19/043 223/111 |

(Continued)

FOREIGN PATENT DOCUMENTS

| | | |
|---|---|---|
| JP | 2003-169744 A | 6/2003 |

*Primary Examiner* — Shaun R Hurley
*Assistant Examiner* — Andrew W Sutton

(57) ABSTRACT

The present invention is a device that provides an expeditious method to invert or turn inside-out and to reform or turn back to the proper side glove appendages, which consists of a base that has numerous openings, one of which accepts a guide. The guide is defined as an asymmetrical cylinder having two (2) opposing ends. One end has a concave configuration and above and adjacent to the other end are a couple of grooves that circumscribe the guide with a couple of flexible elements fitted therein. The latter end is fitted into one of the openings in the base, to be securely mounted therein without using threaded means.

15 Claims, 4 Drawing Sheets

(56) References Cited

U.S. PATENT DOCUMENTS

| | | | | |
|---|---|---|---|---|
| 7,438,256 | B2 * | 10/2008 | Nip | A47K 10/3836 242/597.7 |
| 7,793,603 | B2 * | 9/2010 | Hirate | B65H 49/16 112/302 |
| 2005/0005403 | A1 * | 1/2005 | Jien | E05B 17/002 16/415 |
| 2006/0284001 | A1 * | 12/2006 | Paradise | A47K 10/3836 242/597.4 |
| 2007/0210206 | A1 | 9/2007 | Nip | |

* cited by examiner

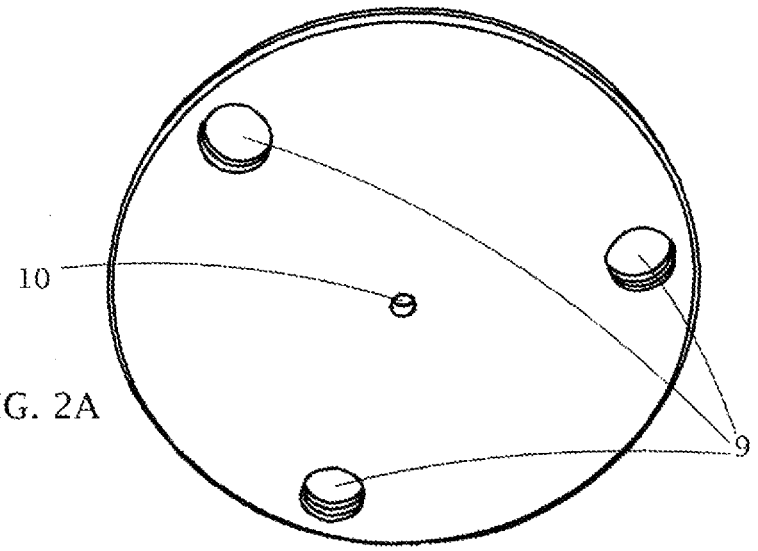
FIG. 2A
FIG. 2B
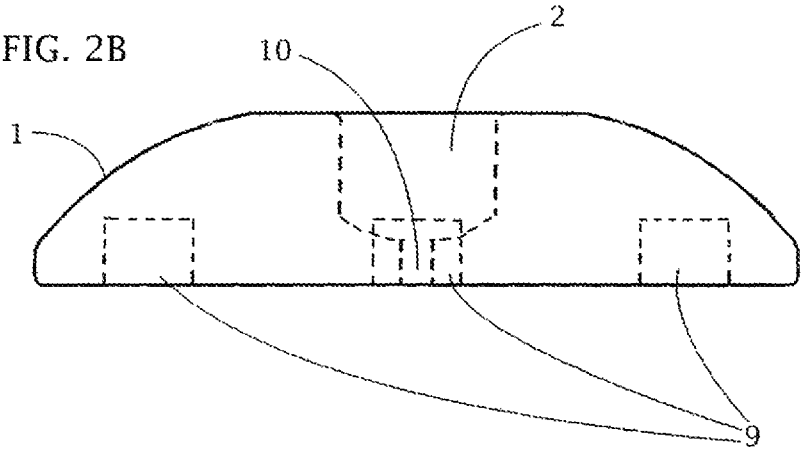

GLOVE INVERTER

The present invention is a CIP (Continuation In Part) of patent application Ser. No. 12/218,837. The inventor of the present invention and the aforementioned application is one and the same. Subsequent to filing the aforementioned application, modifications were made that necessitated filing a CIP and it became apparent that the wording in the prior application was inadequate. Also there are other significant applications this innovation provides. This application also presents significant and major improvements over U.S. Pat. No. 7,210,603 to Smith, Smith and the present inventor is one and the same. This invention relates to the field of gloves as finished products; particularly substantially thick material gloves; notably however not limited to industrial heavy duty lined rubber gloves, ski gloves, leather gloves and multi layered gloves, heat resistant gloves, etc.

FEDERALLY SPONSORED RESEARCH

Not Applicable

SEQUENCE LISTING OR PROGRAM

Not Applicable

BACKGROUND

Technical Field

The present invention relates to a method and apparatus employed to invert finished gloves expeditiously; especially suited however not limited to substantially thick material gloves such as ski gloves, leather gloves, multi layered heat resistant gloves and industrial heavy duty lined rubber gloves; that eliminates maladies of the hands including fungal infections associated with the use of unsanitary and/or damp gloves, thereby promoting healthy morbidity free hands. It also relates to the reformation of previously inverted gloves and eliminates stress and discomfort of the hands typically associated with the use of wet and/or ill fitting, improperly reformed gloves. Moreover, this invention facilitates the expeditious reformation and subsequent proper fit of the gloves. Substantially thick material gloves are extremely difficult and frustrating and time consuming to invert and reform completely and properly by hand.

Prior Art

I would like to urge the reader to consider this as a brand new field per se. The present invention deals with a specific field of inversion/reformation that is notably absent in development, the present invention being an improved version of a first of a kind tool. Most prior art in the field of inversion/reformation deals with tools and/or machines to assist in the manufacture of products. Others deal with oblong finished products such as belts, ties, stockings etc. The present invention deals with gloves as finished products; the purpose of which is to provide a means invert gloves expeditiously thus facilitating efficient cleaning and/or rapid drying of the lining and to reform previously inverted gloves properly thus eliminating discomfort and the concomitant stress associated with ill-fitting and improperly reformed gloves thereby providing a means to promote healthy morbidity free hands for the users of a variety of thick material gloves.

Fabric inversion/reformation of all kinds have employed the use of numerous and varied apparatuses. One component of U.S. Pat. No. 4,749,111 by Hardwick appears similar in structure to the present invention, however there are significant differences, especially the configuration of the tip of the device and the technique employed to invert/reform a fabric and the specific field of application is dissimilar.

U.S. Pat. No. 6,568,572 to Smith is quite similar to the present invention on the surface. Even though it performs a similar function to the present invention, the structural configuration and method are different and it consists of 3 components and requires twice as many steps and requires at least twice as much time to perform the function for which it was devised. Moreover it incurs an added expense to manufacture an additional component. Therefore the need exists for an improvement in the field that costs less to manufacture and is more efficient and requires less time to perform the function of inverting/reforming glove appendages. Also the present invention is lighter and more compact. Case in point; the technique is dissimilar. U.S. Pat. No. 6,568,572 employs a method of insertion: insert the tube into the glove appendage socket; subsequently insert the pushrod into the tube to invert the appendage. Whereas the present invention utilizes a technology based upon a guidance principal, wherein the depression of the tip of the guide provides the contact and stability necessary to eliminate slippage and disengagement of the tip of the glove appendage thereby resulting in complete inversion by virtue of a definitive guidance procedure. Furthermore there are significant improvements the present invention provides. The new technology of the present invention is practically unnoticeable. Precisely, the configuration of the upper section of the guide, configured with a slight inward taper; provides added space to accommodate doubling of the glove material; adapted to and to simulate the shape of a typical baby finger of an average hand minus the tip and more specifically the configuration of the tip of the guide; having a depression configured and adapted to simulate the shape of a typical fingertip thereby eliminating slippage and disengagement with the tip of the glove appendage, and as a result of the depression, complete inversion is accomplished expeditiously. And simultaneously as a result of the tapered upper section of the guide and the uninterrupted seamless smooth surface thereof and the rounded smooth surface of the perimeter of the depression, complete reformation is accomplished expeditiously without hindrance, interference, encumbrance, bunching of the glove fingertips or marked unevenness of the inside or outside surface of the glove appendage.

U.S. Pat. No. 1,537,794 to Baum was not developed to stand-alone nor is it possible in and of itself to perform the function of inverting glove appendages. It was designed as an integral component of larger more complex mechanized machinery. Please refer to U.S. Pat. No. 1,537,794 to Baum; Page 1 (line 9 thru 19, line 37 thru 42, line 51 thru 59, line 88 thru 97, line 107 thru 108); Page 2 (line 7 thru 9). Also the configuration is more closely related to a 2 sided tube with 2 sides exposed. There is absolutely no way to apply the aforementioned patent by itself to perform the function of inverting/reforming glove appendages without employing an additional element or member.

U.S. Pat. No. 2,427,933 to Summers FIG. 4, No. 50 appears similar in configuration to the guide of the present invention however there are significant dissimilarities; the tapered configuration and the depression in the tip and the rounded smooth perimeter of the depression of the present invention as opposed to the shape of the pushrod and the rounded tip thereof of Summers invention. Even though the dissimilarity is practicably unnoticeable, upon scrutiny, it becomes apparent that the difference is substantial and I'm sure, subsequent to a thorough examination of the particular aspects of the present invention, a reasonable assessment would indicate the present invention does not infringe upon U.S. Pat. No. 2,427,933 to Summers or to U.S. Pat. No. 6,568,572 to Smith in view of U.S. Pat. No. 1,537,794 to Baum considering it would not have been obvious to one of ordinary skill in the art to modify the pushrod of Baum (FIG. 1, 2, 3); which is tubular in configuration; by substituting the tip with the tip of the device of Smith (FIG. 4); which is tubular; the reasoning being: without the use or insertion of another element, both devices (Smith and Baum) are completely useless. The device of Baum is a component of a machine of a more complex nature with numerous components that are interdependent on each other and require a variety of parts and mechanisms to perform the function of inverting/reforming glove appendages and it cannot stand alone nor is it portable, whereas the present invention provides a simple manual, non-mechanized device that does not employ the use of any other insertion element to function and can be applied by most people almost anywhere under most circumstances and has only 2 components that can be permanently attached or removeably attached and easily transportable.

OBJECTS AND ADVANTAGES

The purpose of the present invention is to promote a healthy, morbidity free environment in relation to the hands in the workplace and at home by offering an expeditious and trouble free device and method for inverting (turn inside-out)/reforming (turn back to the proper side) glove appendages thus gloves thoroughly.

It is accordingly one object of the present invention to provide a device to invert/reform glove appendages thus gloves that is easy to use and has a surface texture that is smooth and obtuse to provide safety in handling.

It is another object of the present invention to provide a device to invert/reform glove appendages that eliminates the frustration and difficulty altogether of inverting/reforming glove appendages thus gloves by hand.

Another object of the present invention is to provide a time saving device to invert/reform glove appendages thus gloves.

Another object of the present invention is to provide an expeditious method to invert/reform glove appendages thus gloves.

A further object of the present invention is to provide a device to invert glove appendages thus gloves that facilitates efficient cleaning and prompt drying of the lining.

Another object of the present invention is to provide a device to reform glove appendages that eliminates encumbrance or bunching or marked unevenness to the inside or outside surface of the glove appendages resulting in a proper fit.

A further object of the present invention is to provide a device to invert/reform glove appendages thus gloves that is durable and easy to manufacture.

Another object of the present invention is to provide a device to invert/reform glove appendages thus gloves that is economical to produce.

Another object of the present invention is to provide a device to invert/reform glove appendages thus gloves that can be manufactured from metal, plastic, wood or any composite material that is strong enough to withstand the pressure needed to perform the function for which it was designed.

An even further object of the present invention is to provide a device to invert/reform glove appendages thus gloves that can be used on a variety of gloves and glove sizes, meaning the device of the present invention is adapted to be applied on practically any size glove appendage with practically any variety of glove, one size fits all.

Another object of the present invention is to provide a device to invert/reform glove appendages thus gloves that is manual, non-mechanized, lightweight, detachable and easily transportable.

An even further object of the present invention is to provide a device to invert/reform glove appendages thus gloves that can be applied by most people in almost any situation almost anywhere.

Another overlooked, ignored object of the present invention is to provide a device to invert/reform glove appendages thus gloves that eliminates stress, tension and distraction due to wet or ill-fitting, improperly reformed glove appendages thus gloves by keeping hands fine, the mind is focused.

Another very important attribute the present invention provides is a device to invert/reform glove appendages thus gloves that eliminates the necessity of using washers, bolts and threaded means to secure or attach components which is the most common means in the art of attachment.

Finally, it is the main objective of the present invention to provide a device and method to invert/reform glove appendages thus gloves that provides a means to eliminate maladies of the hands, including fungal infections typically associated with the use of substantially thick material gloves and to promote and maintain healthy morbidity free hands by keeping hands dry; Keep Hands Dry, Fungus Can't Thrive™.

SUMMARY

In accordance with the present invention, my glove inverter/reformer is a manual, non-mechanized device that comprises a base and a guide that can be permanently attached or removeably attached without using threaded means. This is a device for inverting/reforming glove appendages thus gloves expeditiously; especially suited for however not limited to substantially thick material gloves including industrial-heavy duty-lined-rubber gloves, ski gloves, leather gloves, heat resistant gloves, multi layered gloves etc. The present invention facilitates efficient cleaning, washing and/or rapid drying of the lining and quick reformation to the proper side with a proper fit. The main objective of the present invention is to promote healthy, morbidity free hands in the workplace and at home.

BRIEF DESCRIPTION OF VIEWS

The present invention will be described hereafter with reference to the attached drawings that are given as non-limiting examples only, in which:

FIGS. 2A and 2B are views of the bottom and side of the base respectively.

Figure 1:
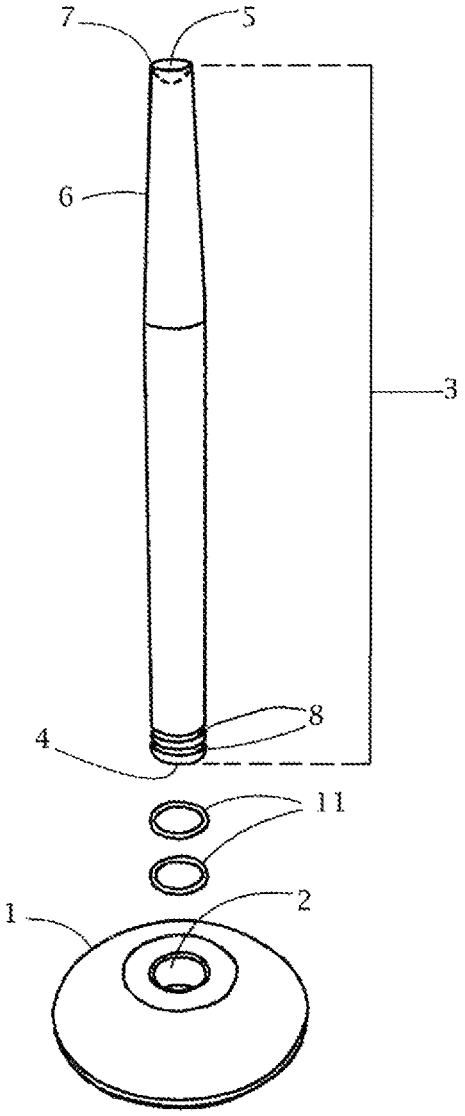
FIG. 1 is a view of the separate components of the glove appendage inverting/reforming device according to one embodiment of the present invention.
Figures 3, 4:
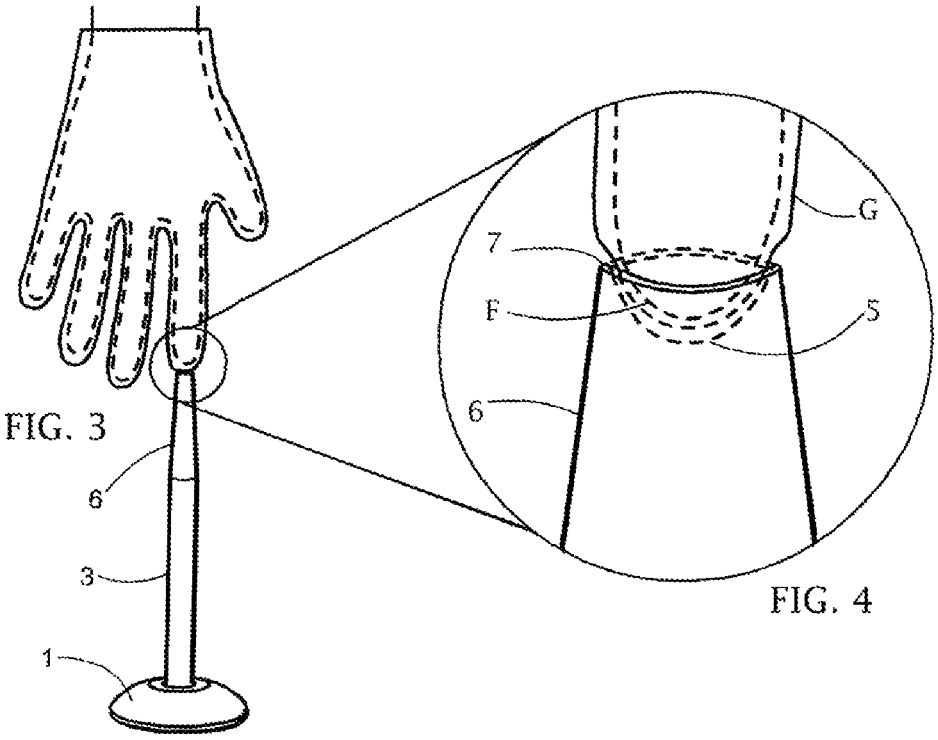
FIG. 3 illustrates the initial procedure of the present invention.
Figure 5:
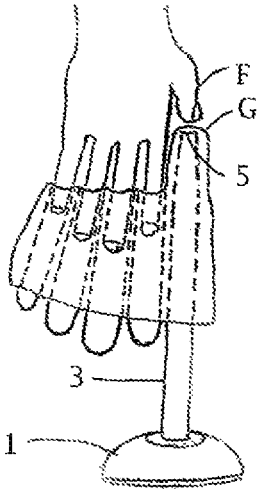
Figure 6:
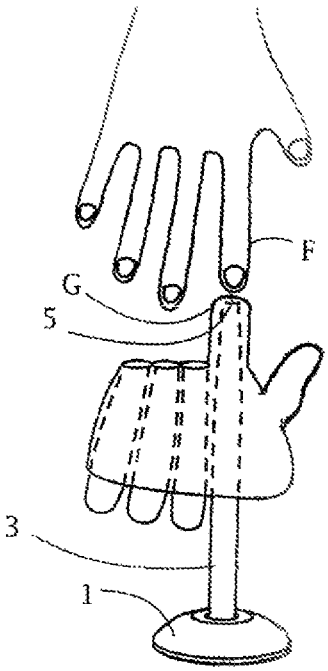

FIGS. 4, 5 and 6 with reference to the drawings, the letters F and G represent finger (F) and glove (G) respectively.

FIG. 4 is an exploded view of the innovation the present invention provides; specifically the unobvious configuration of the upper tapered section, the chamber or concave depression and the perimeter of the depression of this device.

FIG. 5 shows an initial glove finger inverted with the remaining fingers still partially inside the glove appendages according to the method of the present invention.

FIG. 6 shows a second glove finger inverted with the remaining fingers outside of the glove according to the method of the present invention.

DETAILED DESCRIPTION

Further characteristics and advantages according to the present invention will become apparent from the following detailed description of a preferred but not exclusive embodiment thereof.

The glove appendage inverting/reforming device of the present invention is well suited however not limited to industrial, heavy duty, lined, rubber-gloves. It can also be used with any substantially thick material glove, such as ski gloves, leather gloves, heat resistant gloves, multi layered gloves, semi-rubber gloves etc.

The present invention is a manual, non-mechanized device that allows for the trouble free and expeditious inversion (turn inside-out) of glove appendages, thus gloves, thereby facilitating efficient cleaning or washing and/or rapid drying of the lining and quick complete reformation (turn back to the proper side) resulting in a proper fit. Prior to applying the present invention, the guide is inserted into the base to stabilize the guide during application. After the glove is inverted, it is cleaned or washed and the inverted glove is placed in any location such as on a line with a clothes pin, on a tree branch, on a suspended member, on a flat surface, on the grass, in a window sill, on a dashboard or anywhere conducive to allow for aeration that eliminates accumulated moisture and facilitates the inside surface to dry. The device is then applied to turn the glove back to the proper side with a complete and proper fit. This invention provides a means to promote and maintain healthy morbidity free hands by keeping hands dry, fungus can't thrive and by keeping hands fine, focused mind.

The present invention consists of a base (1) that is smooth and obtuse (blunt not sharp) with numerous openings of varying sizes. An opening (2) in the topside accepts the first end (4) of a guide (3). The configuration of the opening (2) is set forth as follows: the opening (2) has a symmetrical cylindrical shape from the beginning of the opening (2) in the top of the base (1) proceeding in a direction towards the bottom of the base (1) for approximately 12.5 millimeters, then near the bottom of the opening (2), the shape changes to a symmetrical concave indentation that continues for a few millimeters (approximately 2.5 millimeters); the concave indentation at the bottom of the opening (2) comprises approximately ⅙ of the total length or depth of the opening (2); where it ends at the bottom of the opening (2). The entire opening (2) in aggregate and as a whole has an asymmetrical configuration. The bottom of the opening (2) connects to the top of a smaller opening (10) in the bottom of the base (1). The opening (2), measured from the top of the base (1) to the bottom of the concave indentation at the center, has a depth of approximately 15 millimeters. The bottom of the base (1) has a series of openings, one smaller opening (10) defined as a conduit (10) which acts as a release valve that allows air to escape from the opening (2) when the first end (4) is inserted therein. The other openings (9) are larger. The smaller opening (10) begins at the bottom of the base (1) and is continuous without any protrusions or abutments and extends to and breaches the bottom of the concave indentation of the larger opening (2) in the topside of the base (1) forming the conduit (10) which is a few millimeters long, approximately 4 millimeters. The length of the opening (2) is approximately four (4) times the length of the conduit (10). The inside of the openings (9) are configured to provide a means to utilize another object such as a screw to attach the device to a larger surface enabling stationary application. The openings (9) are deeper or longer and wider than the conduit (10). The openings (9) and (10) are equidistantly disposed to each other and equidistantly disposed to the boundary of the bottom side of the base (1). The base (1) has a semi-rounded topside with an opening (2) that has a depth and size capable to receive, support, attach, secure and stabilize the first end (4) of a guide (3) without using threaded means. The conduit (10) necessitates being connected to the bottom of the opening (2) to allow air to escape from the cavity of the opening (2) to permit the first end (4) to be completely inserted into the opening (2). Without the conduit (10) connected to the bottom of the opening (2) to allow air to escape, the air pressure in the cavity of the opening (2) would preclude complete insertion or attachment of the first end (4). The smaller opening (10) on the bottom side of the base (1) is centered beneath and connected to the bottom of the concave indentation of the larger opening (2) in the topside of the base (1), the express purpose of the smaller opening (10) is to utilize the conduit (10) to eject air and undesirable matter that could affect the stability thus functionality of the device and to provide a structural element that is one feature in conjunction with other features that make creating an airtight vacuum in the opening (2) possible.

The guide (3) is defined between two opposing parallel ends that are perpendicularly disposed on the longitudinal axis of the guide (3), a first end (4) defined as the nadir and a second end (5) defined as the apex, the first end (4) is inserted and attaches to the base (1) in the opening (2) without threaded means. Adjacent to the first end (4) are a series of singular, solitary, unconnected non threaded non spiral grooves (8) that are smaller in diameter and circumference than the first end (4). The grooves (8) accept a set of flexible elements (11), not relatively, not figuratively, but literally, truly flexible elements (11) that have the properties of rubber or elastic that stretch and subsequently retract to fit over the first end (4) and fit snugly into the grooves (8). The first end (4) has a larger diameter than the inside diameter of the flexible elements (11) and the grooves (8) have a smaller circumference and diameter than the circumference and diameter of the first end (4). By inserting the first end (4) into the opening (2) with the flexible elements (11) fitted and secured in the grooves (8), any moisture, dust, or minute particles and air are forced down through the opening (2) into a smaller opening (10) utilizing the conduit (10) connected to the bottom of the opening (2), the first end (4) then becomes a shut off valve, sealing the top of the smaller opening (10) that breaches the bottom of the opening (2) in the topside, creating and providing an airtight vacuum in the opening (2) between the flexible elements (11) that serve to secure and stabilize the guide (3) without the use of threads and washers and nuts. When the first end (4) is completely inserted into the opening (2) in the topside, the air and any other debris has been pushed out of the opening (2) into the conduit (10) which; when the flexible elements (11) fitted and secured in the grooves (8) are concealed and the flexible elements (11) are in contiguity with the sides of the inside of the opening (2) in the topside; creates the airtight vacuum between the flexible elements (11) mounted in the grooves (8) in the opening (2) in the topside of the base (1). The grooves (8) have a distance between them of approximately 5 millimeters to provide the necessary space to stabilize, secure and/or attach the guide (3) without using threaded means or any other method of attachment. The flexible elements (11) have an inside diameter that is smaller than the diameter of the first end (4) and an outside diameter that is larger than the diameter of the first end (4). The larger outside diameter of the flexible elements (11) provides the contiguity with the inside wall of the opening (2) in the topside of the base (1). The flexible elements (11) mounted in the grooves (8) in concert with the airtight vacuum provide the sole means to quickly and easily detach or quickly and easily attach, secure and stabilize the first end (4) of the guide (3) in the opening (2) in the topside eliminating the need for threaded elements, washers, nuts or screws or any method of adherence or attachment that are commonly used to attach, secure or stabilize components and it provides a method that is quicker and easier than threaded means and/or just as efficient as any other method for attachment or detachment.

The second end (5) has a depression that is incurvated and concave in configuration and has a depth of approximately 3 millimeters, but that likely would not exceed 5 millimeters and a diameter of less than ½ inch at the widest point at the perimeter (7). The dimensions of the second end (5) provide the optimal spatial ratio by limiting the extent of engagement of a glove finger appendage while simultaneously providing sufficient space and depth to insure constant and continuous contact and engagement with a glove appendage tip with a finger inside. The perimeter (7) has a width of less than 1 (one) millimeter. The concave depression (5) has a diameter and circumference of a few millimeters less than the diameter and circumference of the beginning of the inward taper (6), the inward taper begins at a point that separates the upper and lower sections of the guide (3), the beginning of the taper (6) measured from the first end (4) of the guide (3) is approximately ⅔rds the length of the guide (3). The second end (5) has structural properties that could include a hole (the diameter and depth of the hole could be a couple of millimeters, as the case would be when using a tool to center and secure the element when creating the depression or could be the entire length of the guide when using an extruded cylinder) in the center of the bottom of the concave depression (5), the diameter of the hole would not exceed half the distance of the diameter of the concave depression (5) at its inception at the perimeter (7). This specific configuration delivers the optimal spatial ratio by limiting the extent of engagement of a glove finger appendage so as not to get stuck in a larger hole, while simultaneously securing constant engagement to an extent just enough to prevent slippage and provide ease of disengagement to facilitate the application of subsequent glove finger appendages quickly. The concave depression (5) is shaped to simulate and adapt to the configuration of an average typical glove appendage tip with a fingertip inside including an average typical thumb tip. The concave depression (5) is enclosed by a curvilinear perimeter (7) that is obtuse (blunt not sharp) and has a smooth surface. The perimeter (7) is apically disposed and circumscribing the depression (5) and is the point that separates the depression (5) from the dimensional abatement (6). Beginning in the upper section of the guide (3), approximately the upper third of the guide (3), well below the second end (5) culminating with the curvilinear perimeter (7) is an oblique dimensional abatement (6). The dimensional abatement (6) is adapted to simulate the shape of an average and typical baby finger of a hand minus the tip, having a symmetrical inward taper or conversely an outward taper; depending on the perspective; that has a constant gradual gradient and a degree of angle that is measured or calculated by the dimensions of the starting point in the upper section of the guide (3) and the length and the dimensions of the culmination point at the perimeter (7).

The guide (3) has 2 (two) sections, a lower symmetrical section and an upper symmetrical section, but combined, as a whole and taken in aggregate, the combined sections that constitute the guide (3) produce an asymmetrical shape, top to bottom, bottom to top. Each section of the guide (3) has a dissimilar length and dissimilar configuration, the lower section is a symmetrical cylinder and the upper section is a symmetrical taper. The lower section has a length that is longer than the upper section. The upper section is the dimensional abatement (6) defined as an inward taper (6) that begins at a point well above the first end (4) and above a point that is half the length of the guide (3) and the taper (6) constitutes a fraction of the aggregate length of the guide (3) which is approximately $\frac{1}{3}^{rd}$ of the length of the guide (3). The taper (6) provides the necessary space to accommodate doubling of the glove appendage material when inverting and reforming the glove appendages. The present invention has a similar texture, configuration and structure when viewed from any side and between the perimeter (7) and the uppermost groove (8), there is no angle greater than the angle of the dimensional abatement (6). Between the perimeter (7) and the uppermost groove (8), the guide (3) has a surface structure that is uninterruptedly flush, seamless, smooth and obtuse (blunt not sharp) and has absolutely no interstices or areas void of structure except in the case of a different configuration of another embodiment.

The base (1) is very light-weight and is sized (approximately 3 inches in diameter), configured and adapted to fit comfortably in the palm of any averaged sized hand, be it any teenager or older person regardless of the size or shape of the average typical hand and could have a semi-rotund topside. The dimensions (diameter) of the base (1) could be larger or smaller when adapted to another embodiment of the present invention. The bottom of the base (1) could be flat to provide stability on most surfaces and would be small and of a size and shape that is easily manipulated by practically any hand. The base (1) would have a smooth obtuse (blunt not sharp) surface texture around the opening (2). The base (1) and guide (3) could be permanently attached or removeably attached.

The guide (3) could have a variety of configurations, one embodiment could be a longitudinally protracted member or cylindrical (approximately no more than 10 inches long) with a symmetrical inward taper (6) beginning with greater dimensions in an upper section of the guide (3) culminating with lesser dimensions at the perimeter (7), and of a size sufficient to receive practically any size glove appendage and a length sufficient to invert/reform the glove appendage without hindrance, encumbrance or interference; the device of the present invention is configured so that basically 1 (one) size is adapted to and can accommodate a variety of size, shape and type of glove appendage; 1 (one) size fits all. A first end (4) is of a size that fits into the opening (2) in the base (1) and a second end (5) having a depression surrounded by a curvilinear perimeter (7) that is obtuse and has a smooth texture. The guide (3) could have a symmetrical inward taper (6) that simulates, conforms and is adapted to the configuration of an average and typical baby finger of an average and typical shaped hand minus the tip and has a smooth, continuous, uninterrupted flush surface. The inward taper (6) has a length that comprises about ⅓$^{rd}$ of the length of the guide (3). Other embodiments are possible, however with the embodiment of the present invention, the guide (3) has an uninterrupted continuously flush, smooth seamless surface texture beginning perpendicular to the uppermost groove (8) including the dimensional abatement (6) defined as an inward taper (6) that is below and adjacent to the perimeter (7), culminating with the perimeter (7) that has no interstices, no off-set elements, no ripples, no junctures, joints or connecting pieces, no abutments or articulations, no protrusions, no recessions, no edges, no ridges, and no voids except with another embodiment thereby eliminating encumbrance, hindrance, interference bunching of the glove fingertips or marked unevenness to the inside or outside surface of the glove appendage during the inversion process and eliminates encumbrance, hindrance, interference, bunching of the glove fingertips or marked unevenness to the inside surface of the glove appendage during the reformation process thus providing expeditious inversion and reformation of the glove appendages thus gloves. The second end (5) is a concave depression (5) having a diameter of less than ½ inch with a depth of approximately 3 millimeters and of a size capable of receiving a fingertip of a gloved finger. The dimensions of the second end (5) structurally limits the depth of engagement to approximately 3 millimeters, which is a length that is configured and adapted to conform to that of the tip of practically any glove appendage tip of practically any variety of glove. The present invention is configured to conform to a variety of sizes and types as a one size fits practically any glove appendage size, type, shape, configuration etc. by being specifically designed to accommodate such a variety. The technology is in the configuration of the unobvious concave tip that allows for accommodating such a variety of sizes, shapes, configurations etc. The second end (5) of the guide (3) could have a hole in the bottom of the depression (5) that is small enough to prevent a glove appendage from becoming stuck while simultaneously insuring continuous engagement and contact with the apex of the tip of a gloved finger. The perimeter (7) of the depression (5) is obtuse (blunt not sharp) and smooth further facilitating quick and complete inversion of glove appendages thus gloves producing the desired effect with no marked unevenness to the inside or outside surface of the glove appendage in preparation for efficient cleaning and/or rapid drying of the lining and reformation (turn back to the proper side) of the inverted (turned inside out) glove is performed expeditiously and completely resulting in a proper fit. The flush, obtuse (blunt not sharp) and smooth surface of this device further provides a means for safety in handling. The device, the guide (3) attached to the base (1), has the exact same configuration when viewed from any side. However in accordance with another embodiment, the aforementioned may not apply.

The placement of the conduit (10) that is centered beneath the opening (2) in the base (1) and the properties created by flexible elements (11) in the grooves (8) in contiguity with the inside walls of the opening (2) in the base (1) provide features that are non-visible or concealed when the first end (4) is completely inserted, attached and secured in the opening (2). These are inherent and functionally important features of the present invention that are the epitome and criteria of unobviousness, novelty and innovation.

Any material whatsoever, be it rigid or flexible that is capable of withstanding the pressure necessary to perform the function of the present invention without fracturing or otherwise rendering it inoperable and can be molded, shaped, cut, cast, manufactured, etc. in the configuration according to the invention can be employed in the construction thereof.

One preferred however non-limiting method for applying the present invention that is likely the most efficacious is set forth as follows: for a removeably attached application; place the base (1) with a flat bottom side on a surface, fit the flexible elements (11) into the grooves (8) by stretching them over the first end (4) and then retract to securely fit into the grooves (8), fit the first end (4) of the guide (3) into the opening (2) in the base (1). As the flexible elements (11) engage the sides of the wall of the inside of the opening (2) and the first end (4) of the guide (3) is pushed into the opening (2) any moisture or debris and air will be expelled out through the bottom of the opening (2) into the conduit (10) out through the small opening (10) in the bottom of the base (1). The opening (2) does not extend to the bottom of the base (1), the opening (2) connects to the opening (10) and the opening (10) extends to and breaches the bottom of the base (1). Once the guide (3) is fully inserted into the opening (2), the flexible elements (11) are in constant contiguity with the wall of the inside of the opening (2) and the grooves (8) and the flexible elements (11) fitted therein are concealed, no longer visible and the first end (4) becomes a stop valve or shut off valve, sealing off the top of the small opening (10), the flexible elements (11) in constant contiguity (contact) with the wall of the inside of the opening (2) thus create an airtight vacuum between the set of flexible elements (11) simultaneously attaching, securing and stabilizing the guide (3) without threaded means. All edges of the base and guide are smooth and obtuse, all inclusive.

The guide (3) extends from the topside of the base (1) in a direction perpendicular to the surface. In the process of taking the glove off, invert it as much as possible. Use any finger of your choosing to start with. Engage the tip of a first gloved finger with a finger inside; the first gloved finger containing a finger could be a gloved thumb containing a thumb; with the second end (5) of the guide (3) substantially perpendicular to the surface. Use the apex of the finger inside the glove appendage to engage and maintain continuous contact with the concave depression (5) of the guide (3) as you grasp the cuff of the glove with the second hand and peel the glove down in a direction that is substantially perpendicular to the surface over the guide (3) until the first gloved finger is completely inverted. As a result of this process, the remaining fingers will be partially out of the glove appendages. Choosing any finger to continue with the inversion process, resituate the finger and fingertip so as to have contact with the glove appendage tip and repeat the above (same) procedure with a gloved finger containing a finger selected from the group consisting of a second gloved finger containing a finger, a third gloved finger containing a finger, a fourth gloved finger containing a finger and a fifth gloved finger containing a finger until each gloved finger and the glove is completely inverted. Repeat the aforementioned steps to reform an inverted (inside-out) glove by firstly putting the inside out or inverted glove on a hand. Follow the same process to invert a glove, to turn the glove back to the proper side with complete reformation resulting in a proper fit. After use, the device detaches easily for placement in a tool kit, bag or fits just as easily in a pocket providing ease of portability and transporting.

For a permanently attached application, the guide (3) extends from the topside of the base (1) in a direction perpendicular to the surface. From this point, the process is the same as for a removeably attached application delineated above.

CONCLUSIONS, RAMIFICATIONS, AND SCOPE

Accordingly, you can see that the present invention eliminates the difficulty and frustration of inverting/reforming glove appendages by hand altogether and dramatically reduces the time necessary to perform the function of inverting/reforming glove appendages. Furthermore, the present invention can be applied much easier, considerably faster and more effectively than by hand or any prior art in the field. Complete inversion of glove appendages is accomplished expeditiously thereby facilitating efficient cleaning or washing and rapid drying of the lining. And complete reformation of glove appendages is accomplished expeditiously, eliminating hindrance, interference, encumbrance or marked unevenness of the inside or outside surface of the glove/glove appendage. Even further, the present invention provides a highly reliable, lightweight, manual, non-mechanized (powered only by hand power), permanently attached or detachable, portable, multi-faceted yet economical device that can be applied by persons of almost any age almost anywhere under most conditions or circumstances. Moreover, use of the present invention ameliorates the condition of the hands by providing a healthy, morbidity free environment thus eliminating stress which affects concentration which affects efficiency which affects productivity in the workplace or at home.

Although the detailed description above contains specificities, these should not be construed as limitations on the scope of the invention, but rather as an exemplification of one preferred embodiment thereof. Other variations are possible. For example, the size can vary, the shape can vary, the material employed to construct the device can be any material(s); natural, artificial, composite, etc. that can be rigid or flexible, but capable of withstanding the pressure necessary to perform the function for which it is designed without fracturing or otherwise rendering the device inoperable. Moreover, this device can be used with or without the base.

What is claimed is:

1. A device to turn inside-out or invert and turn back to the proper side or reform glove appendages thus gloves expeditiously utilizing the fingers of one of two hands with the second of two hands comprising:

a base that has numerous openings of varying sizes with an opening configured to receive a guide, said base has a surface texture that is smooth and obtuse;

a guide, having a series of grooves that accept a set of flexible elements, the guide is defined between two (2) opposing parallel ends, a first end and a second end, both ends perpendicularly disposed on the longitudinal axis of said guide with a perimeter apically disposed surrounding said second end, said guide has 2 (two) sections, each having a symmetrical configuration, the 2 (two) sections combined as a whole and in aggregate form said guide, said guide has an asymmetrical configuration from top to bottom, said second end is defined as a depression, the depression is parallel to the first end, said depression has a depth that would not exceed 5 millimeters, said guide having a dimensional abatement adjacent to and below the perimeter, said first end is received by an opening in said base;

wherein said guide is sized, configured and adapted to accept a variety of glove appendage sizes and types and invert and reform a variety of glove appendage sizes and types, said guide is securely stabilized in said opening in said base and attaches to said base without threaded means, said opening that accepts said guide begins with a cylindrical shape and near the bottom the shape changes to a concave indentation, the concave indentation has a depth of a few millimeters.

2. The device of claim 1 wherein said opening in said base that accepts said guide is on the top of said base and has a depth sufficient to conceal said first end of said guide including said grooves with said flexible elements fitted therein further wherein the series of openings on the bottom-side of said base are equidistantly disposed to each other and equidistantly disposed to the boundary of the bottom-side of said base and 1 (one) of the openings in the bottom-side of said base is smaller than the others, the smaller opening that begins at the bottom of said base is centered beneath and is continuous without protrusions or abutments, breaches and is connected to the bottom of said concave indentation in the bottom of said opening in the topside that receives said guide forming a conduit that is a 4 millimeters long, the other openings are configured to provide means for attachment to a larger surface and are longer and wider than the conduit.

3. The device of claim 1 wherein said grooves are singular, solitary, unconnected and non-spiraling, said grooves circumscribe said guide above and parallel to said first end, each of said grooves accept flexible elements that must stretch to fit over a larger diameter first end and retract to fit snugly in a smaller circumference groove, said flexible elements have a smaller inside diameter than said first end and a larger out-side diameter than said first end, said grooves have a smaller circumference than said first end, said grooves with said flexible elements mounted therein are separated by approximately 5 millimeters, said first end of said guide including said flexible elements inserted completely into said base, said first end forms a shut off valve, said first end seals said smaller opening in the bottom of said opening in said topside to form an airtight vacuum between said flexible elements, the airtight vacuum is formed when said flexible elements are in constant contiguity with the wall of the insides of said opening that accepts said first end of said guide.

4. The device of claim 1 wherein said depression of said second end is concave and configured with a depth of 3 millimeters with a width of 1 millimeters less than the diameter of said guide at the point that separates the upper and lower sections of said guide.

5. The device of claim 1 wherein said perimeter is defined as the point of separation between said concave depression and said dimensional abatement, said concave depression having a size capable to engage and maintain continuous contact with the apex of a glove appendage with a finger inside of, said dimensional abatement is defined as an inward taper beginning with greater dimensions at an upper section of said guide, culminating with lesser dimensions at said perimeter, the length of said inward taper is $\frac{1}{3}^{rd}$ of the length of said guide, said inward taper is a constant gradual gradient having an angle measured by the dimensions of the starting point in the upper section of said guide and the length and the dimensions of the culmination point at said perimeter.

6. The device according to claim 1 wherein, said guide has a surface texture and configuration that is smooth and all edges are obtuse and said guide attached to said base have the exact same configuration viewed from any side.

7. The device according to claim 3 wherein, said flexible elements in concert with said airtight vacuum attaches, secures and stabilizes said guide without threaded means or any other method for attachment and said flexible elements in concert with said airtight vacuum provides the sole means for attachment.

8. A method of inverting or turning inside out glove appendages with an inside and an outside utilizing the fingers of one of two hands with the second of two hands, including an apparatus consisting of:

a base, having openings in the topside and bottom side, one opening in the top of the base accepts a guide and one opening in the bottom side is smaller than the others and connected to the opening that accepts the guide;

a guide, defined between two ends, a first end and a second end, the first end having a series of grooves adjacent thereto, the grooves circumscribing the guide parallel to said first end and perpendicularly disposed on the axis of said guide, said grooves accept a set of flexible elements, the second end having a depression surrounded by a perimeter, said perimeter is the point of separation between the depression and a taper, said taper beginning in an upper section of said guide culminating with said perimeter, said first end completely inserted in the top of said base creates an airtight vacuum between the set of flexible elements, said flexible elements fitted in said grooves in concert with the airtight vacuum provides the sole means for attaching said guide to said base without using threaded means or any other means for attaching, wherein said base and said guide have a surface texture that is smooth and obtuse;

comprising the steps of:

a) placing a base with a flat bottom side on a surface, fit the flexible elements into the grooves of said guide, fit said guide into the opening in the top of said base, said flexible elements expelling any moisture, air, dust or debris through said opening in the topside of said base through said smaller opening in the bottom side, wherein said guide extending from the top side of said base in a direction perpendicular to a surface tapers, said depression is of a size capable of maintaining continuous contact with the apex of a tip of a gloved finger;

b) choosing any finger, inserting the tip of a glove finger containing a finger in said depression wherein said gloved finger is substantially perpendicular to a surface;

c) grasping a cuff of the glove with a second hand;

d) peeling the cuff down in a direction that is substantially perpendicular to a surface while maintaining continuous contact between the apex of a gloved fingertip and said depression until the first glove finger is completely inverted;

e) repeating steps (b) through (d) with a finger selected from the group consisting of a second glove finger containing a finger;

f) repeating steps (b) through (d) with a finger selected from the group consisting of a third glove finger containing a finger;

g) repeating steps (b) through (d) with a finger selected from the group consisting of a fourth glove finger containing a finger;

h) repeating steps (b) through (d) with a finger selected from the group consisting of a fifth glove finger containing a finger, until each glove finger and the glove is completely inverted.

9. The method of claim 8 wherein said guide is attached to said base without using threaded means for attachment.

10. The method of claim 8 wherein said taper provides the necessary added space for doubling of the glove appendage material facilitating quick inversion of the glove appendages.

11. The method of claim 8 wherein utilizing said guide by inserting into said base, said guide having a continuous uninterruptedly flush seamless surface above the uppermost groove adjacent to said first end, including said taper and said perimeter, provides a means for complete inversion of the glove appendages.

12. A method of reforming or turning back to the proper side an inverted or inside-out glove with an inside and an outside expeditiously utilizing the fingers of one of two hands with the second of two hands, including an apparatus consisting of:

a base, having openings in the topside and bottom side, one opening in the top of the base accepts a guide and one opening in the bottom side is smaller than the others and connected to the opening in said topside;

a guide, defined between two ends, a first end and a second end, the first end having a series of grooves adjacent thereto circumscribing the guide parallel to the first end, the grooves are perpendicularly disposed on the axis of said guide, said grooves accept a set of flexible elements, said first end completely inserted in the opening in the top of said base create an airtight vacuum between the set of flexible elements, the second end having a depression surrounded by a perimeter, said perimeter is the point of separation between the depression and a taper, the taper beginning in an upper section of said guide culminating with said perimeter;

comprising the steps of:

a) placing a base with a flat bottom side on a surface, fit the flexible elements into the grooves of the guide, fit said guide into the opening in the top of the base expelling any moisture, air, dust or debris through said opening in the top of said base out through said smaller opening in said bottom side, wherein the guide extending from the top of said base in a direction perpendicular to a surface tapers;

b) putting an inverted or inside-out glove on a hand;

c) choosing any finger, inserting the tip of an inverted or inside-out glove finger containing a finger in said depression, wherein said inverted or inside-out glove finger is substantially perpendicular to a surface;

d) grasping a cuff of the inverted or inside out glove with a second hand;

e) peeling said cuff down in a direction that is substantially perpendicular to a surface while maintaining continuous contact between the apex of a fingertip in said inverted or inside-out glove finger and said depression until the first inverted or inside-out glove finger is completely reformed;

f) repeating steps (c) through (e) with a finger selected from the group consisting of a second inverted or inside-out glove finger containing a finger;

g) repeating steps (c) through (e) with a finger selected from the group consisting of a third inverted or inside-out glove finger containing a finger;

h) repeating steps (c) through (e) with a finger selected from the group consisting of a fourth inverted or inside-out glove finger containing a finger;

i) repeating steps (c) through (e) with a finger selected from the group consisting of a fifth inverted or inside-out glove finger containing a finger, until each glove finger and the glove is completely reformed.

13. The method of claim 12 wherein said taper provides the necessary added space for doubling of the glove appendage material while reforming said appendages thereby facilitating quick reformation of the glove appendages.

14. The method of claim 12 wherein said base and said guide are detachable without the use of threaded means facilitating placement in a tool kit, bag or pocket further providing means facilitating transporting.

15. The method of claim 14 wherein said base and said guide are detached without using threaded means.

* * * * *